US010125502B1

(12) United States Patent
Mastrovasilis

(10) Patent No.: US 10,125,502 B1
(45) Date of Patent: Nov. 13, 2018

(54) SIDING HOLDER

(71) Applicant: Pantelis Mastrovasilis, Tarpon Springs, FL (US)

(72) Inventor: Pantelis Mastrovasilis, Tarpon Springs, FL (US)

( * ) Notice: Subject to any disclaimer, the term of this patent is extended or adjusted under 35 U.S.C. 154(b) by 0 days.

(21) Appl. No.: 15/883,777

(22) Filed: Jan. 30, 2018

(51) Int. Cl.
*E04F 21/18* (2006.01)

(52) U.S. Cl.
CPC ..... *E04F 21/1855* (2013.01)

(58) Field of Classification Search
CPC .... E04D 3/3605; F27D 1/144; E04F 13/0848; E04F 21/1855; E04F 21/185; E04F 21/0007; B60T 17/046; F16M 13/00; B25J 1/04
USPC ..... 52/748.1
See application file for complete search history.

(56) References Cited

U.S. PATENT DOCUMENTS 1,467,799 A * 9/1923 Larsen ..... B25J 1/04 294/22
1,598,986 A 9/1926 Ping
3,792,852 A 2/1974 Reniker
4,155,175 A 5/1979 Stiles
4,937,950 A 7/1990 Farnworth
5,065,537 A * 11/1991 Bailey ..... G09F 7/12 294/211
5,623,767 A 4/1997 Colavito
5,692,311 A * 12/1997 Paquin ..... E04D 15/04 33/647
7,124,551 B1 10/2006 Patera
7,393,031 B2 * 7/2008 Goulet ..... B60P 7/0853 294/210
7,546,692 B2 6/2009 Simko
7,610,734 B2 11/2009 Edwards et al.
2002/0170198 A1 11/2002 Rempe
2005/0235446 A1 10/2005 Eggers
2007/0068115 A1 3/2007 Ouellette et al.
2009/0107084 A1 4/2009 Hutchings
2013/0333197 A1 * 12/2013 Schulte ..... B25J 1/04 29/525.08

* cited by examiner

*Primary Examiner* — Stephen A Vu
(74) *Attorney, Agent, or Firm* — Richard C. Litman

(57) ABSTRACT

The siding holder includes a planar body having first and second longitudinally opposed ends, an upper surface and a lower surface. A siding panel holding assembly is secured to the first end of the planar body for releasably holding a bottom portion of a first siding panel for installation thereof An alignment abutment plate is releasably secured to the lower surface of the planar body, adjacent the second end thereof, and has a longitudinally adjustable position relative to the planar body. The alignment abutment plate is adapted to abut a bottom edge of a second siding panel which has already been installed. A pivotal handle connector is secured to the upper surface of the planar body and is provided for removable attachment of a handle.

17 Claims, 7 Drawing Sheets

SIDING HOLDER

BACKGROUND

1. Field

The disclosure of the present patent application relates to construction tools, and more particularly to a siding holder for holding and aligning siding during installation thereof on a building.

2. Description of the Related Art

Installing siding is a tedious and repetitive task, often requiring cooperative interaction between several workers to measure, cut, level and mount the siding onto the side of a building being constructed. Further, siding is usually installed in overlapping panels which, at times, may be difficult to align consecutively mounted panels. The amount of handling and repetition involved in the siding installation process tends to exacerbate potential human errors and result in misaligned siding panels and/or undue physical strain on the worker. If a siding panel is improperly aligned, it can create a situation in which the panels do not overlap sufficiently to protect the building from the elements; e.g., rain may seep into the walls of the building. Thus, a siding holder solving the aforementioned problems is desired.

SUMMARY

The siding holder includes a planar body having first and second longitudinally opposed ends, an upper surface and a lower surface. A siding panel holding assembly is secured to the first end of the planar body for releasably holding a bottom portion of a first siding panel for installation thereof An alignment abutment plate is releasably secured to the lower surface of the planar body, adjacent the second end thereof, and has a longitudinally adjustable position relative to the planar body. The alignment abutment plate is adapted to abut a bottom edge of a second siding panel which has already been installed. A pivotal handle connector is secured to the upper surface of the planar body and is provided for removable attachment of a handle.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

As shown in FIGS. 1A-4, the siding holder 10 includes a substantially flat, planar body 12, having first and second ends that serve different functions (as will be described in greater detail below). Although shown as being rectangular, it should be understood that the planar body 12 may have any desired overall contouring and relative dimensions. For the non-limiting example of a flat rectangular body 12, exemplary dimensions include a width of 6 inches, a length of 12 inches, and a thickness of 0.25 inches. The siding holder 10 simplifies siding panel installation by reducing the majority of the measuring and alignment issues involved in siding while also requiring less physical effort from the user.

Figure 1A:
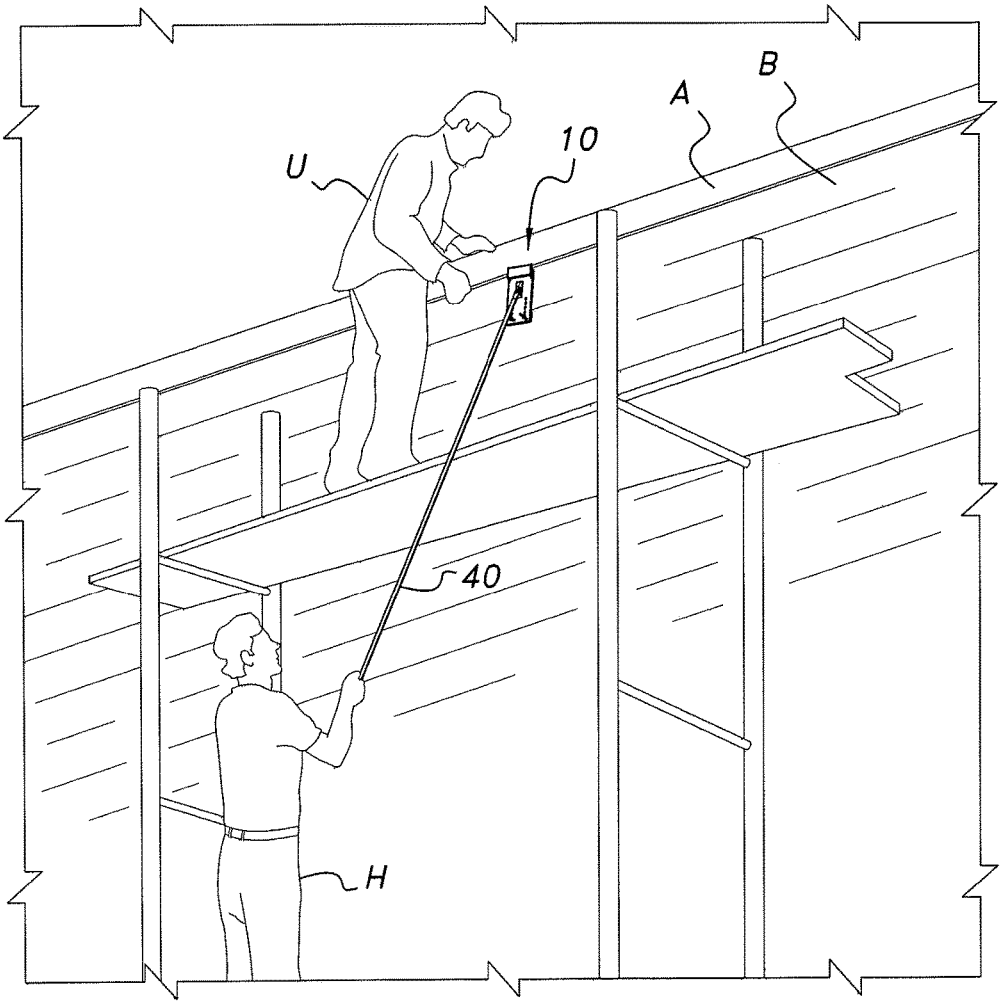
FIG. 1A is an environmental, perspective view of a siding holder.
Figure 1B:
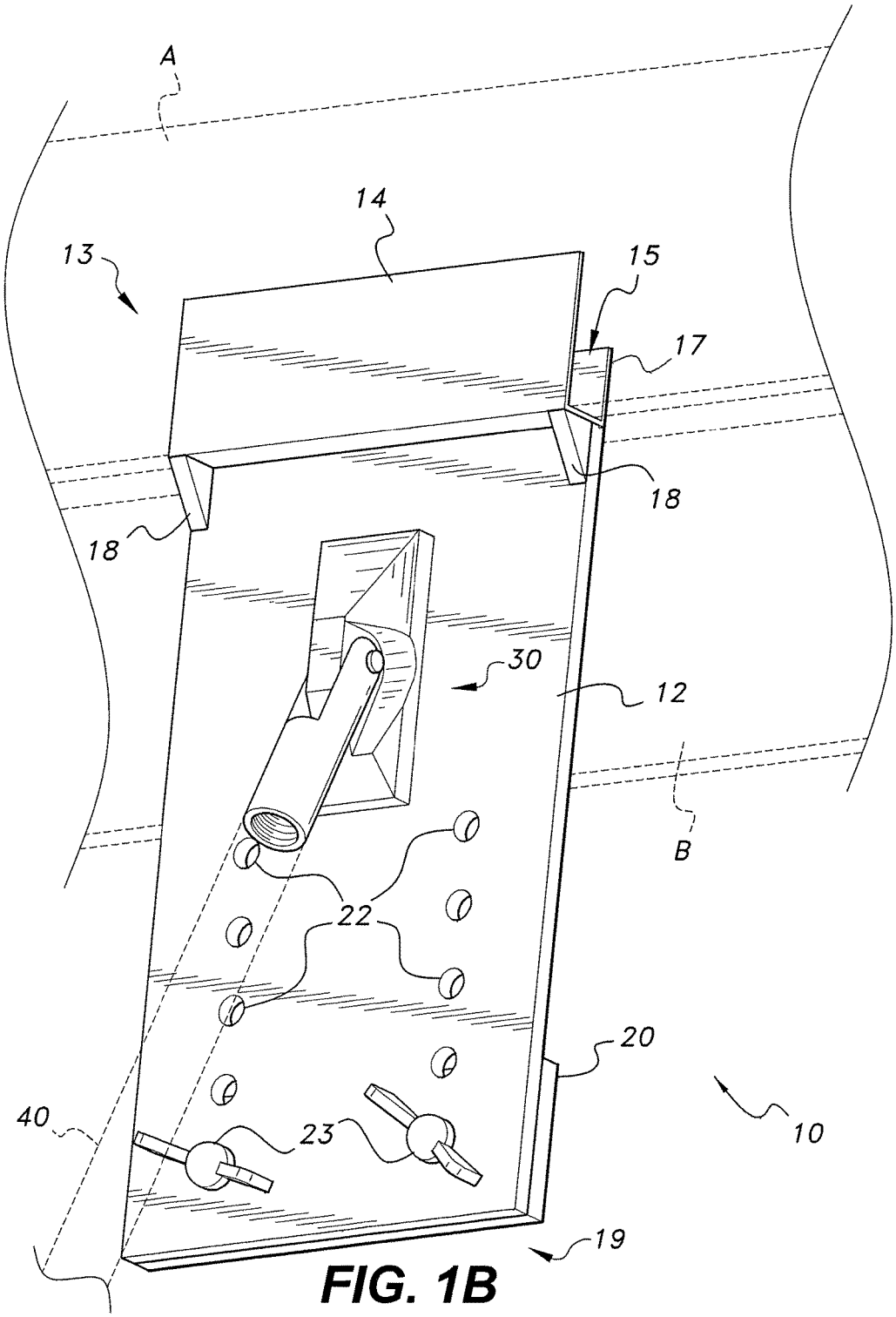
FIG. 1B is an enlarged, perspective view of the siding holder.
Figure 2:
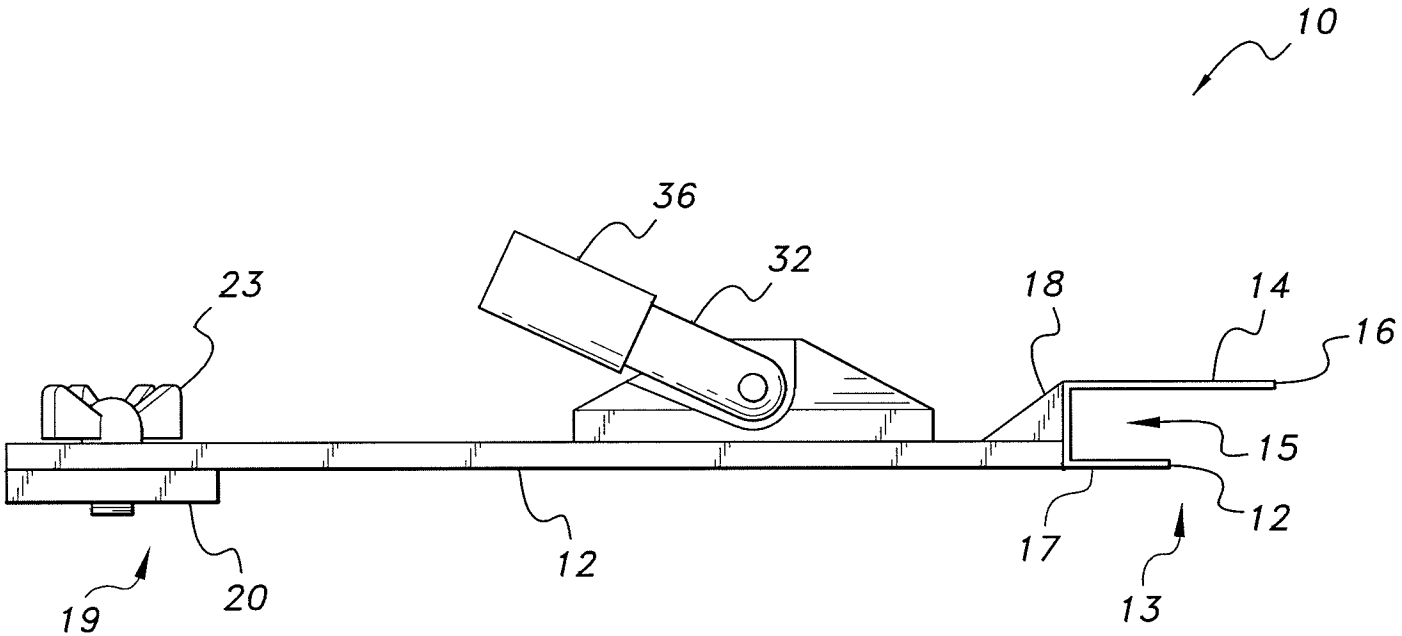
FIG. 2 is a side view of the siding holder.

As shown in FIGS. 1B and 2, the first end 13 of the planar body 12 includes a substantially U-shaped (in cross section), siding panel holding bracket 14 attached to the body 12 via welding, adhesives, fasteners or the like. The upper and lower extensions 16, 17 of the bracket 14 are uneven in length and form a siding panel holding groove or slot 15 therebetween. Corresponding to the exemplary dimensions given above, upper extension 16 may have a length of 2 inches, lower extension 17 may have a length of 1 inch, and the siding panel holding slot 15 may have a thickness of 1 inch. Thus, the siding panel holding slot 15 can accommodate any siding up to 1 inch in thickness. The longer upper extension 16 provides stability in holding and pressing a siding panel being installed, while the shorter lower extension 17 provides support for the siding panel.

As best shown in FIG. 2, the lower extension 17 is flush or co-linear with the bottom face of the planar body 12, which leaves most of the bracket 14 extending above the top surface of the body 10. This may potentially cause undesirable warping or bending of the bracket through repetitive use. Thus, in order to compensate, the siding holder 10 includes wedge-shaped stabilizing fins or flanges 18 between the bracket 14 and the planar body 12 to ensure rigid and squared disposition between them. The flanges 18 may be attached via welding, adhesives, fasteners or the like.

Figure 4:
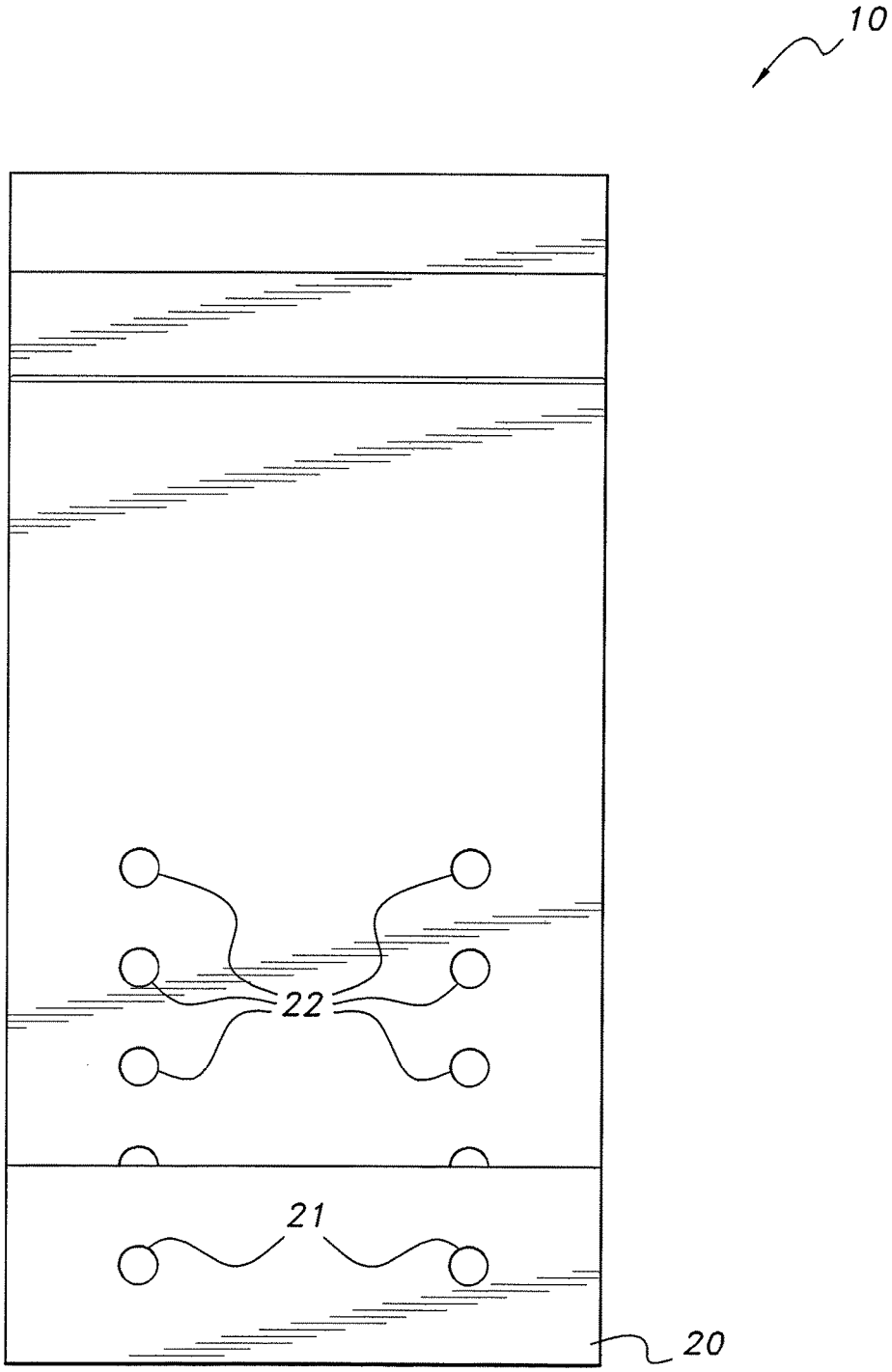
FIG. 4 is a bottom view of the siding holder.

The second end 19 of planar body 12 includes an adjustable alignment abutment 20, which serves to abut against a previously installed siding panel B. The abutment 20 is pre-adjusted by an abutment fixing system to define the desired spacing between successive panels. The abutment 20 may be a substantially rectangular block having threaded fixing holes 21, for example, as shown in FIG. 4. The flat squared edges of the abutment 20 ensure proper alignment of panels.

Figure 3:
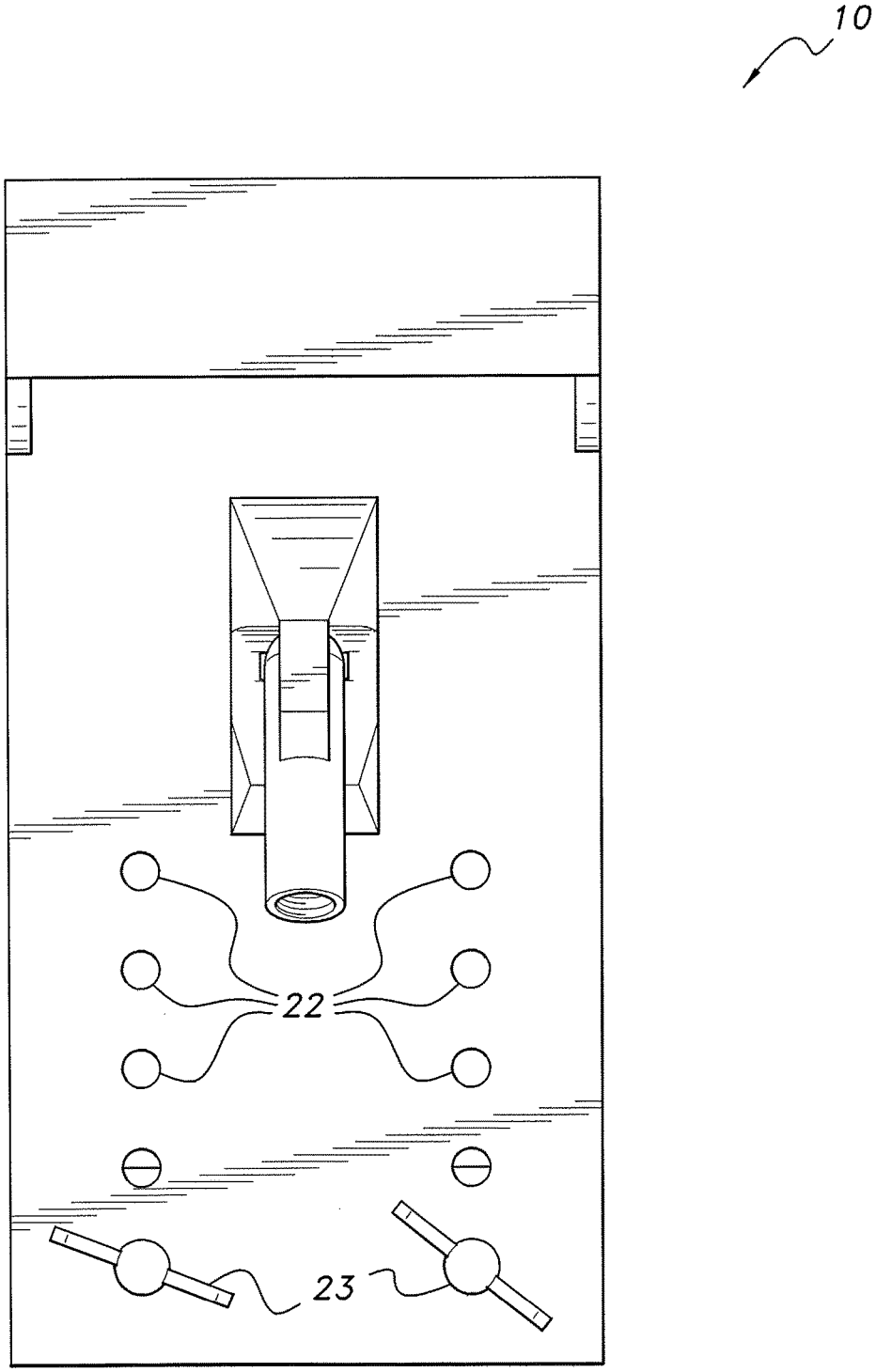
FIG. 3 is a top view of the siding holder.

As shown in FIGS. 1B, 3 and 4, the abutment fixing system of the siding holder 10 includes a plurality of pairs of threaded fixing holes 22 and threaded fasteners or wing nuts 23. Each pair of fixing holes 22 is disposed along the lower half-length of the planar body 12, and the pairs of fixing holes 22 are spaced at regular intervals thereon, as shown. It should be understood that the disposition and spacing of the holes may be varied depending on the desires of the owner or changes in industry standards.

In order to affix the adjustable abutment 20 at the proper position for the desired panel spacing, the wing nuts 23 are threaded through the respective fixing holes 22 and the fixing holes 21 in the abutment 20 to thereby securely fasten and affix the positioning of the abutment 20. Referring to FIG. 4, abutment 20 is positioned such that fixing holes 21 are aligned with a desired pair of fixing holes 22, and abutment 20 is secured to the planar body 12 at this position by the pair of wing nuts 23. Thus, it can be seen that the correlation between the bracket 14 and the adjustable abutment 20 pre-sets panel spacing while eliminating much of the handling necessary for alignment thereof.

Figure 5A:
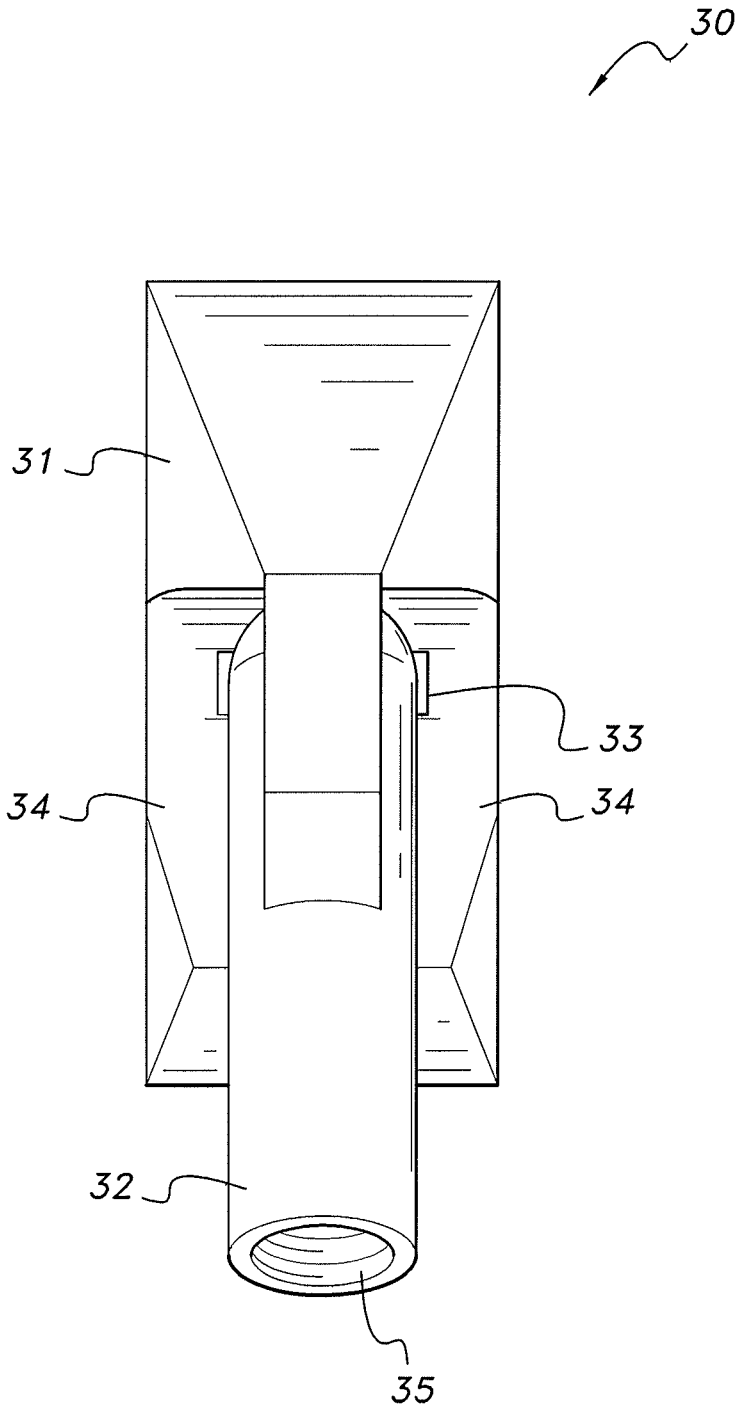
FIG. 5A is a top view of a pivotable handle connector of the siding holder.
Figure 5B:
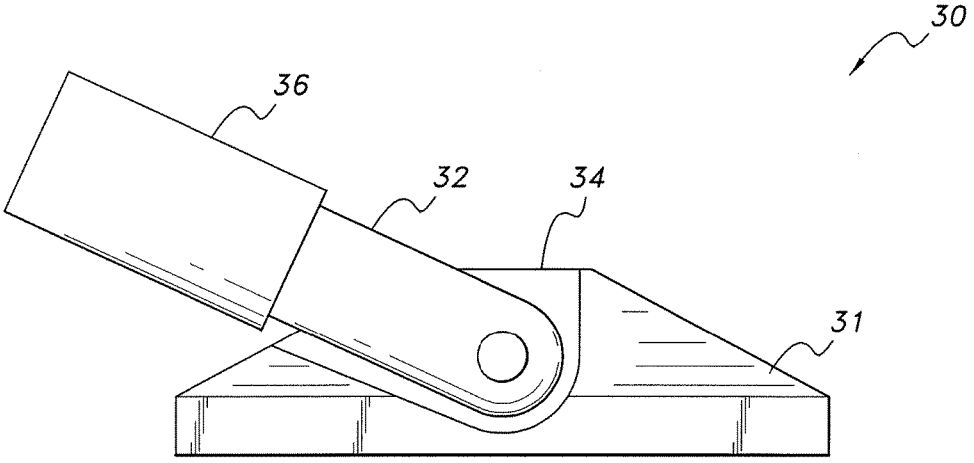
FIG. 5B is a side view of the pivotable handle connector of the siding holder.

As shown in FIGS. 1B, 5A and 5B, the siding holder 10 includes a pivotal handle connector 30. The pivotal handle connector 30 includes base 31 with a handle connecting member 32 pivotally mounted to base 31 by a pivot pin 33.

Although base 31 is shown as having a substantially trapezoidal shape, it should be understood that base 31 is shown for exemplary purposes only and may have any desired overall contouring and relative dimensions. The connecting member 32 is yoked at the pivotal end while the opposite end includes a threaded bore 35 for a secure threaded attachment to an elongated handle 40. The base includes arcuate grooves 34 on either side thereof to limit rotational travel of the handle 40.

The above configuration of the handle connector 30 allows for versatile employment of the siding holder 10. For example, as illustrated in the configuration of FIG. 5B, when the user is installing a siding panel from ground level, a rubber grip sleeve 36 disposed on the connecting member 32 may replace the elongated handle 40, since the extra length of the handle 40 would not be required. With respect to the handle 40, the handle 40 may be of any length that is suitable for the task and comfortably useful by the user.

In use, the abutment 20 of the siding holder 10 is initially adjusted to the proper spacing for the task. In FIG. 1A, helper H is shown using the elongated handle 40 to position the siding holder 10 against the previously installed siding panel B. User U then places the next siding panel A into the siding panel holding slot 15 for subsequent installation of siding panel A. The user U then completes installation of panel A by nailing panel A to the building wall. Thus, it can be seen that the siding holder 10 may reduce human error, and the consequences thereof, by reducing excessive physical strain from constant monitoring of panel spacing and alignment during the installation process.

It should be understood that the siding holder 10 may encompass a variety of alternatives to the various features described above. For example, the siding holder 10 may be made from wood, plastic, aluminum or any other suitable sturdy materials. The planar body 12, siding panel holding bracket 14, stabilizing flanges 18, adjustable abutment 20, and handle connector 30 may be formed integrally, via molding or the like, or may be secured together. Further, the location of the flanges 18 may be reconfigured as long as they maintain structural support between the bracket 14 and the body 12. Furthermore, although some specific dimension examples have been noted above, the siding holder 10 may be sized in a variety of ways to accommodate various sized workpieces, the ergonomics of the siding holder 10 and/or the manufacture thereof. As a further note, the handle 40 may be telescoping to expand the reach of the siding holder 10.

It is to be understood that the siding holder is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A siding holder, comprising:

a planar body having first and second longitudinally opposed ends, an upper surface and a lower surface;

a siding panel holding assembly secured to the first end of the planar body, the siding panel holding assembly being adapted to releasably hold a bottom portion of a first siding panel for installation thereof;

an alignment abutment plate releasably secured to the lower surface of the planar body, adjacent the second end thereof, the alignment abutment plate having a longitudinally adjustable position relative to the planar body, whereby the alignment abutment plate is adapted to abut a bottom edge of a second siding panel which has been installed, further wherein the alignment abutment plate has at least one alignment abutment plate opening formed therethrough, the planar body having a longitudinally extending array of sets of planar body openings formed therethrough, wherein each set of planar body openings comprises at least one planar body opening;

a pivotal handle connector secured to the upper surface of the planar body; and a handle attached to the pivotal handle connector.

2. The siding holder as recited in claim 1, wherein the siding panel holding assembly comprises a substantially U-shaped bracket.

3. The siding holder as recited in claim 2, wherein the substantially U-shaped bracket has upper and lower extending arms defining a siding panel holding slot therebetween.

4. The siding holder as recited in claim 3, wherein the upper extending arm has a greater longitudinal length than the lower extending arm.

5. The siding holder as recited in claim 4, wherein a lower surface of the lower extending arm is positioned adjacent and contiguous to the lower surface of the planar body.

6. The siding holder as recited in claim 2, further comprising at least one mounting flange secured to, and connecting, the substantially U-shaped bracket and the upper surface of the planar body.

7. The siding holder as recited in claim 1, further comprising at least one fastener, whereby the at least one alignment abutment plate opening is aligned with a selected set of planar body openings, and the alignment abutment plate is releasably secured to the planar body by the at least one fastener passing through the at least one alignment abutment plate opening and the selected set of planar body openings.

8. The siding holder as recited in claim 7, wherein the at least one alignment abutment plate opening comprises a pair of alignment abutment plate openings.

9. The siding holder as recited in claim 8, wherein each of the sets of planar body openings comprises a pair of planar body openings.

10. The siding holder as recited in claim 9, wherein the at least one fastener comprises a pair of fasteners.

11. The siding holder as recited in claim 10, wherein the pair of fasteners comprise a pair of wing nuts.

12. The siding holder as recited in claim 1, wherein the handle is removably attached to the pivotal handle connector.

13. A siding holder, comprising:

a planar body having first and second longitudinally opposed ends, an upper surface and a lower surface;

a siding panel holding assembly secured to the first end of the planar body, the siding panel holding assembly being adapted to releasably hold a bottom portion of a first siding panel for installation thereof;

an alignment abutment plate releasably secured to the lower surface of the planar body, adjacent the second end thereof, the alignment abutment plate having a longitudinally adjustable position relative to the planar body, whereby the alignment abutment plate is adapted to abut a bottom edge of a second siding panel which has been installed;

a pivotal handle connector secured to the upper surface of the planar body; and a handle attached to the pivotal handle connector, wherein the handle is removably attached to the pivotal handle connector.

14. The siding holder as recited in claim 13, wherein the siding panel holding assembly comprises a substantially U-shaped bracket.

15. A siding holder, comprising:

a planar body having first and second longitudinally opposed ends, an upper surface and a lower surface;

a siding panel holding assembly secured to the first end of the planar body, the siding panel holding assembly being adapted to releasably hold a bottom portion of a first siding panel for installation thereof;

an alignment abutment plate releasably secured to the lower surface of the planar body, adjacent the second end thereof, the alignment abutment plate having a longitudinally adjustable position relative to the planar body, whereby the alignment abutment plate is adapted to abut a bottom edge of a second siding panel which has been installed;

a pair of alignment abutment plate openings formed through the alignment abutment plate;

a longitudinally extending array of sets of planar body openings formed through the planar body, each set of planar body openings including a pair of planar body openings;

a pair of fasteners extending through the pair of abutment plate openings and the pair of planar body openings in the selected set of planar body openings for releasably securing the alignment abutment plate to the planar body a pivotal handle connector secured to the upper surface of the planar body; and a handle attached to the pivotal handle connector.

16. The siding holder as recited in claim 15, wherein the pair of fasteners comprise a pair of wing nuts.

17. The siding holder as recited in claim 15, wherein the handle is removably attached to the pivotal handle connector.

* * * * *